US008727171B1

(12) United States Patent
Ong

(10) Patent No.: US 8,727,171 B1
(45) Date of Patent: May 20, 2014

(54) MULTI-COMPARTMENT FOOD PREPARATION APPARATUS

(75) Inventor: Michael Ong, Union City, CA (US)

(73) Assignee: Ongma Enterprise Corporation, Union City, CA (US)

( * ) Notice: Subject to any disclaimer, the term of this patent is extended or adjusted under 35 U.S.C. 154(b) by 26 days.

(21) Appl. No.: 13/426,335

(22) Filed: Mar. 21, 2012

(51) Int. Cl.
*B65D 1/36* (2006.01)
*B65D 25/04* (2006.01)

(52) U.S. Cl.
USPC ..... 220/505; 220/555

(58) Field of Classification Search
USPC ..... 220/505, 553, 555, 556, 527; D7/513, D7/555, 632, 635
See application file for complete search history.

(56) References Cited

U.S. PATENT DOCUMENTS

| | | | | | |
|---|---|---|---|---|---|
| 185,791 | A | * | 12/1876 | Smith | 220/555 |
| 386,964 | A | * | 7/1888 | Cochran | 211/55 |
| 1,238,830 | A | * | 9/1917 | Schuster | 401/129 |
| 1,494,978 | A | * | 5/1924 | Roy | 220/553 |
| D99,827 | S | * | 5/1936 | Scaman | D7/555 |
| 3,106,314 | A | * | 10/1963 | Spears | 221/35 |
| 3,429,474 | A | * | 2/1969 | Cann | 220/555 |
| D219,675 | S | * | 1/1971 | Davis | D7/535 |
| 4,061,242 | A | * | 12/1977 | Donlon | 220/506 |
| D283,476 | S | * | 4/1986 | Mansueto | D7/513 |
| D295,010 | S | * | 4/1988 | Mansueto | D7/513 |
| D353,745 | S | * | 12/1994 | Rinard | D7/637 |
| 5,487,486 | A | * | 1/1996 | Meneo | 220/504 |
| 5,490,608 | A | * | 2/1996 | Hawkins | 220/524 |
| D373,707 | S | * | 9/1996 | Seaburg | D7/513 |
| D395,577 | S | * | 6/1998 | Miller | D7/590 |
| 6,006,936 | A | * | 12/1999 | Przybylowicz | 220/23.8 |
| D421,462 | S | * | 3/2000 | Orchanian | D19/77 |

OTHER PUBLICATIONS www.mrspringrroll.com, MR Spring Roll's, Special and Unique Rice Paper Bowls; archive.org, Apr. 21, 2010, 2 pages.

* cited by examiner

*Primary Examiner* — Mickey Yu
*Assistant Examiner* — Niki Eloshway
(74) *Attorney, Agent, or Firm* — Mahamedi Paradice Kreisman LLP

(57) ABSTRACT

An apparatus is disclosed that includes a base, a first compartment and a second compartment. The first compartment is enclosed at the base and has a first opening, and the second compartment is enclosed at the base has a second opening. The first compartment is adjoined to and positioned on the base, and has a wall that is substantially perpendicular to the base. The second compartment is adjoined to and positioned on the base and shares at least a portion of the wall. The second opening is smaller than the first opening.

18 Claims, 4 Drawing Sheets

MULTI-COMPARTMENT FOOD PREPARATION APPARATUS

BACKGROUND OF THE INVENTION

In some instances when a large group of people gather together for a meal, table space can limit the amount of serving platters and/or plates that can be placed on the table simultaneously. In addition, for certain types of meals where there are a large variety of different foods and ingredients that must be provided simultaneously on a table, space can still be an issue despite having fewer people gathered together.

BRIEF DESCRIPTION OF THE DRAWINGS

The disclosure herein is illustrated by way of example, and not by way of limitation, in the figures of the accompanying drawings and in which like reference numerals refer to similar elements, and in which.

DETAILED DESCRIPTION

Embodiments described herein include a mufti-compartment apparatus that is capable of holding liquids and/or other materials. The apparatus can be used for meals where table space can be limited. In some examples, the apparatus can hold rice paper in one compartment and water in another compartment for meals in which people are making their own spring rolls.

According to an embodiment, the apparatus includes a base, a first compartment, and a second compartment. Each compartment has a respective opening, and is adjoined to and positioned on the base. Each compartment is also enclosed at the bottom, either near or at the base. The first compartment has a wall that is substantially perpendicular to the base, and the second compartment shares at least a portion of the wall. The opening of the second compartment is smaller than the opening of the first compartment.

As used herein, the term "substantial" or its variants (e.g. "substantially") is intended to mean at least 75% of the stated quantity, measurement or expression. The term "majority" is intended to mean more than 50% of such stated quantity, measurement, or expression.

Each compartment has a height measured from the base to its opening. In some embodiments, the height of the first compartment is taller than the height of the second compartment so that the compartments have different sizes. In other embodiments, the widths and/or lengths of the compartments can vary in size so that the width of the first compartment can be larger than the width of the second compartment.

In some embodiments, the compartments of the apparatus may have different shapes (in addition to different sizes) so that they are not symmetric to each other. The first compartment and/or the second compartment can have a width that is constant for a portion of its height and then decreases in size along the height moving towards the base. Similarly, the first compartment and/or the second compartment can have a length that is constant for a portion of its height and then decreases in size along the height moving towards the base.

The apparatus can be formed from a translucent or semi-translucent material so that a user can partially see what is inside the compartments. The apparatus can also be formed of a variety of different materials (or combinations of materials), such as plastic, metal, ceramic, or glass. In some embodiments one or both of the compartments can be sealed so that liquid can be held by one or both of the compartments. The first and/or second compartment can also have a graphic (e.g., a patterned graphic or an image) that identifies a material or product that can be placed in the compartment. Combinations of other features and embodiments are provided.

Overview

Figure 1A:
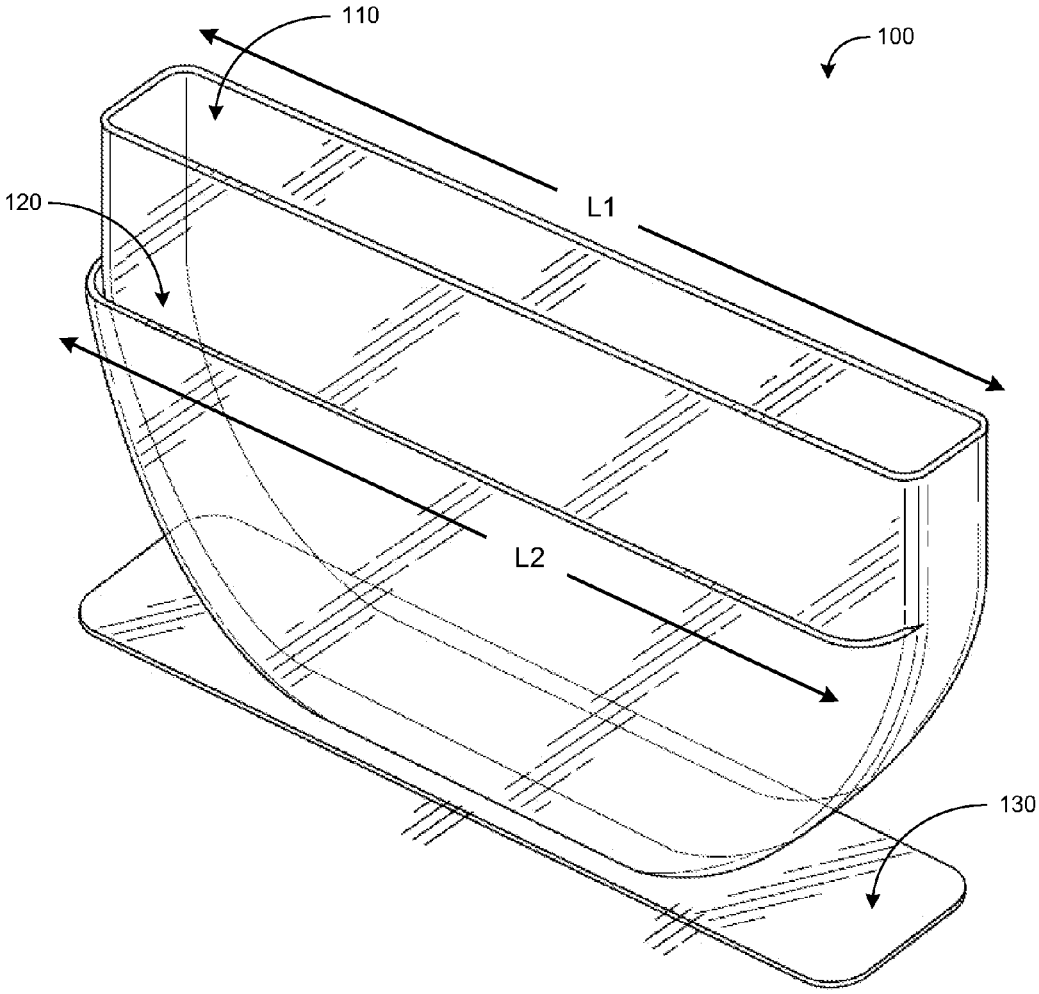
FIG. 1A illustrates a multi-compartment apparatus, under an embodiment.
Figure 1B:
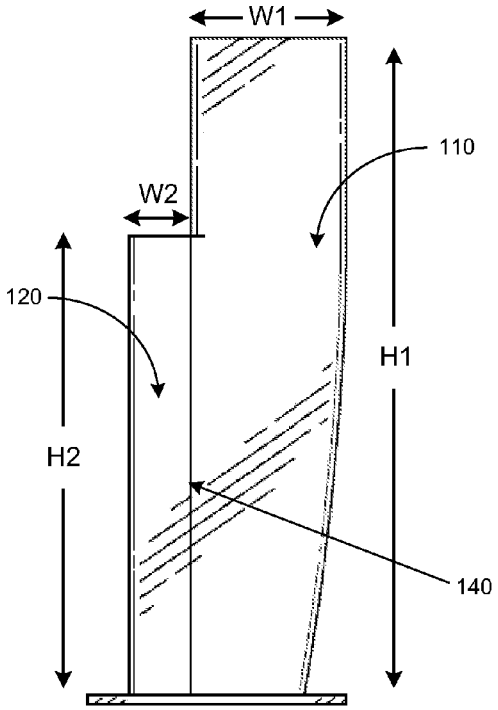
FIG. 1B illustrates a side view of the mufti-compartment apparatus, under an embodiment.
Figure 1C:
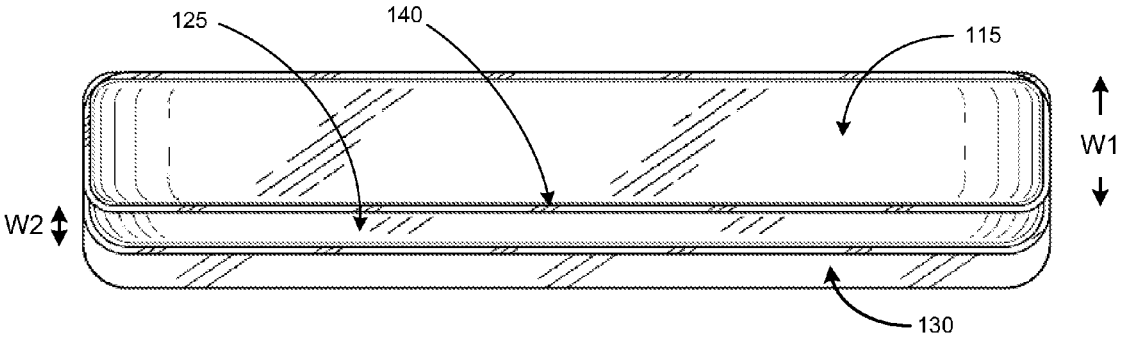
FIG. 1C illustrates a top view of the mufti-compartment apparatus, under an embodiment.

FIGS. 1A-1C illustrate different views of a mufti-compartment apparatus, under an embodiment. Apparatus 100 includes a first compartment 110, a second compartment 120 and a base 130. The first compartment 110 and the second compartment 120 are enclosed at the base 130 (e.g., each of the compartments can retain liquid). The first compartment 110 includes a length L1, height H1, and width W1, and the second compartment 120 includes a length L2, height H2, and width W2. The first compartment 110 has a first opening 115 and the second compartment 120 has a second opening 125. The first compartment 110 also has a wall 140 that is substantially perpendicular to the base 130. At least a portion of the wall 140 is shared by the second compartment 120 (e.g., a portion of the wall 140 can be seen as being a wall of the second compartment 120).

According to an embodiment, the first compartment 110 can be significantly larger in volume than the second compartment 120 (or in other embodiments, vice versa, so that the second compartment 120 is larger in volume than the first compartment 110). The opening 115 of the first compartment 110 can be larger than the opening 125 of the second compartment 120 (by area), and/or the height H1 of the first compartment 110 can be taller than height H2 of the second compartment 120. In addition, the width W1 of the first compartment 110 can be wider than the width W2 of the second compartment 120.

In some embodiments, the apparatus 100 can be used to hold liquid, such as water, and/or other materials, such as rice paper. Rice paper is a thin sheet of edible paper made from parts of a rice plant, like rice straw or rice flour. In some foreign countries/cultures, such as in Vietnam or other Asian countries, a meal (e.g., a family dinner) may consist of individuals gathered together around a table preparing and making their own spring rolls (or summer rolls). A user may we a sheet of rice paper and place various ingredients, such as slices of meat, seafood or eggs, with vegetables (such as sprouts, cucumbers) and other herbs/sauces, on the rice paper. The rice paper is initially stiff, but after being dipped in water, it is softened so that it may be rolled up and wrapped together into a roll. According to an embodiment, the second compartment 120, which can have a width W2 that is thinner than the width W1, can be used to hold a package of sheets of rice paper or individual sheets of rice paper. For example, because the second compartment 120 can be sealed (except for the opening 125), it can hold individual sheets of rice paper without the product package/wrapper that they are provided and sold in. Because sheets of rice paper are very thin, the second compartment 120 can also have a small width W2 compared to the width W1 of the first compartment (e.g., half the size). At the same time, the first compartment 110 can be larger than the second compartment 120 in order to hold more water in the first compartment 110 than the second compartment 120, and the opening 115 of the first compartment 110 can be large enough to enable a user to easily dip a sheet of rice paper in water that is contained in the first compartment 110.

In one embodiment, the first compartment 110 can have four walls, where the opening 115 is substantially rectangular in shape (the opening can have four sides with four curved corners). In other embodiments, the opening 115 may be a different shape, such as an elliptical shape or an elongated hexagonal shape, for example, so that the number of walls can be different. The walls of the first compartment 110 can combine with the base 130 to form the first compartment 110. The first compartment 110 can be watertight and sealed so that water can be poured in through the opening 115 and contained in the first compartment without leaking. As discussed above, the first compartment 110 includes a wall 140 that is substantially perpendicular to the base 130 and is shared by the second compartment 120. One or more other walls (or none of the walls) of the first compartment 110 can be curved or angled to have a particular shape (such as a portion of a circular shape that reflects the shape of a sheet of rice paper or a tortilla—which is circular in shape). The first and/or second compartments 110, 120 of the apparatus 100 can have portions that are rounded in shape (and other portions that are flat in shape).

For example, the first compartment 110 can have a length L1 that is constant in size for a portion of the height H1. For a remaining portion of the height H1, the length L1 can decrease in size in a direction towards the base 130 (see FIG. 1A). Similarly, the first compartment 110 can have a width W1 that is constant in size for a portion of the height H1, and then decrease in size in a direction toward the base 130 (see FIG. 1B). In other embodiments, the size of the width W1 and/or the length L1 can increase in size in a direction toward the base 130 so that W1 and/or L1 is larger in size near the opening 115.

The second compartment 120 can also be shaped similarly to at least a portion of the first compartment 110. It can also be sealed and watertight. This can give the apparatus 100 a more unified look and provide balance to the apparatus 100 when the compartments hold/contain liquid and/or other materials. The width W2 and/or the length L2 can decrease in a direction toward the base 130 so that the second compartment 120 can have a curved or angled shape (such as a portion of a circular shape that reflects the circular shape of a sheet of rice paper). For example, FIG. 1B shows an embodiment where the second compartment 120 has a width W2 that is constant (e.g., the wall of the second compartment 120 is parallel to the wall 140). In one embodiment, the shape of the second compartment 120 can be formed so that it shares the wall 140 of the first compartment 110 and look like a portion or cut out of the first compartment 110. In other embodiments, the second compartment 120 may have a different shape and form (e.g., rectangular shape) than the first compartment 120. The second compartment 120 may also be watertight (however, in other embodiments, the second compartment 120 does not have to be sealed or watertight).

The various dimensions of the apparatus 100 may vary. According to an embodiment, the length L2 of the second compartment 120 at or near the opening 125 can be large enough to hold sheets of edible rice paper. For example, rice paper, which are circular in shape, can be approximately 22 cm or 31 cm in diameter, depending on brand, and the length L2 of the second compartment 120 can have a length that is larger than the rice paper (to ensure that it can hold the rice paper). In addition, the height H2 of the second compartment 120 can be smaller than the height H1 of the first compartment 110 so that when the edible rice paper is placed in the second compartment 120, it can be easily grabbed by a user (because a larger portion of the rice paper can be projected out of the opening 125).

In some embodiments, the openings 115 and 125 of the first and second compartments 110, 120, respectively, are positioned to be parallel to the base. In other embodiments, the openings may be slanted or sloped so that the height H1 may be shorter from one side of the opening 115 to the base 130 than another side of the opening 115 to the base 130 (similarly for the second compartment).

The apparatus 100 may have a variety of different shapes and sizes. In some embodiments, as illustrated in FIGS. 1A-1C, the apparatus 100 may have a base 130 that is flat and has two sets of parallel sides and four curved corners (e.g., in a shape substantially similar to that of a rectangle with curved corners). In other embodiments, the base 130 may have different shapes (e.g., triangular, elliptical, circular, hexagonal, octagonal, etc.), but is capable of balancing and holding up the two compartments 110, 120 with or without the two compartments 110, 120 holding/containing liquids and/or other materials. The base 130 may also have a different thickness (e.g., may be thicker in length, width, or height) than what is illustrated for better supporting the two compartments 110, 120.

The apparatus 100 can be formed of a translucent or semi-translucent material (such as a glass or plastic) so that a user can see the contents of the first and second compartments 110, 120. For example, by being from a translucent or semi-translucent material, the user can see whether water is contained in the first compartment 110 and the water level (e.g., whether more water is needed). The apparatus 100 may also be formed from a variety of different materials (or a combination of them), such as plastic, metal, ceramic, or glass. The apparatus 100 can be heavier or lighter depending on the thicknesses of the various portions of the apparatus 100 and the materials used to form the apparatus 100. In other embodiments, the type of material used to form the apparatus 100 can provide better balancing when the compartments 110, 120 hold or contain liquids and/or other materials.

Figure 2:
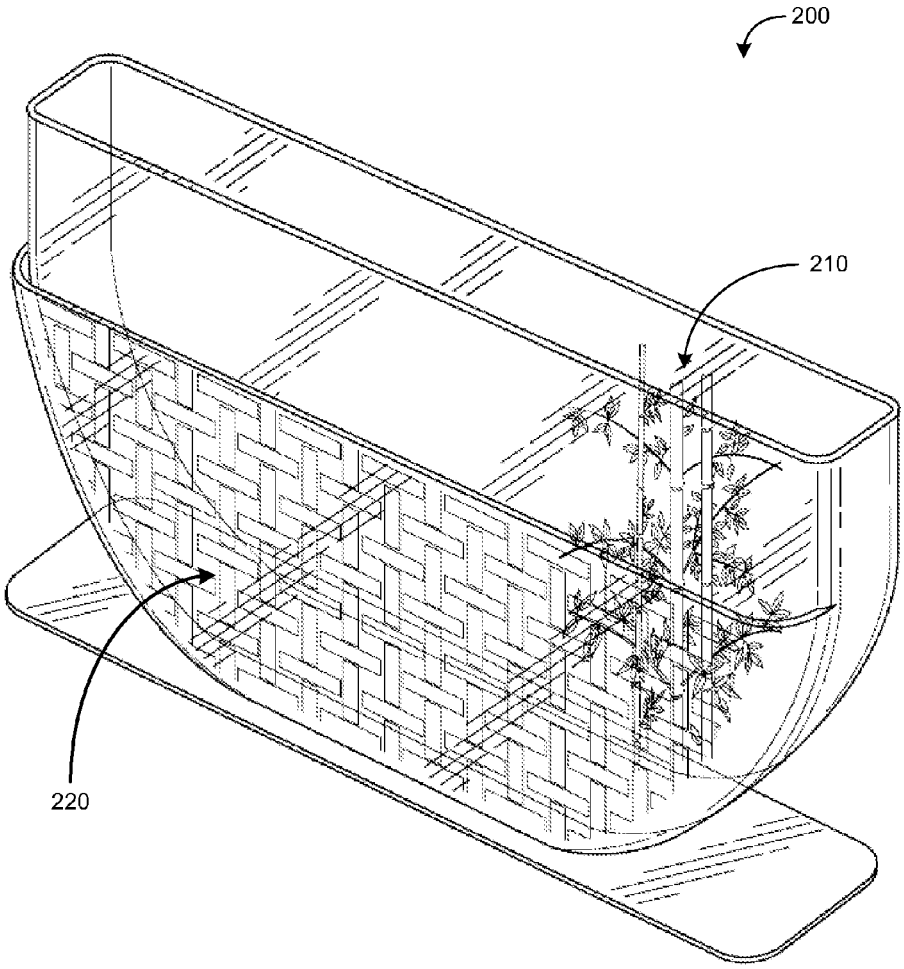
FIG. 2 illustrates a multi-compartment apparatus, under another embodiment.

FIG. 2 illustrates a multi-compartment apparatus, under another embodiment. The apparatus 200 is similar to that of the apparatus 100 in FIGS. 1A-1C, but include graphics on the surface of the compartments for indicating or identifying what type of material or product should be put or placed inside the compartment. For example, the apparatus 200 is shown to be translucent so that the graphic 210, which is provided on the outside of the first compartment, can be seen in FIG. 2. The graphic 210 is facing away from the graphic 220, which is provided on the outside of the second compartment (i.e., the two graphics are facing in opposite directions from each other). The graphics 210, 220 can be printed on the material of the apparatus 200 (or be printed on a different material and attached to the apparatus 200 using an adhesive) and/or be textured. The graphic 220 can be a patterned graphic, for example, that is visually similar to the texture and pattern found on the edible rice paper. The rice paper typically has a similar textured graphic as shown in FIG. 2. In this manner, a first time user can know immediately what compartment to store the edible rice paper in versus what compartment to pour water into (e.g., store the rice paper in the second, smaller compartment 120, where the graphic 220 is provided on).

Figure 3:
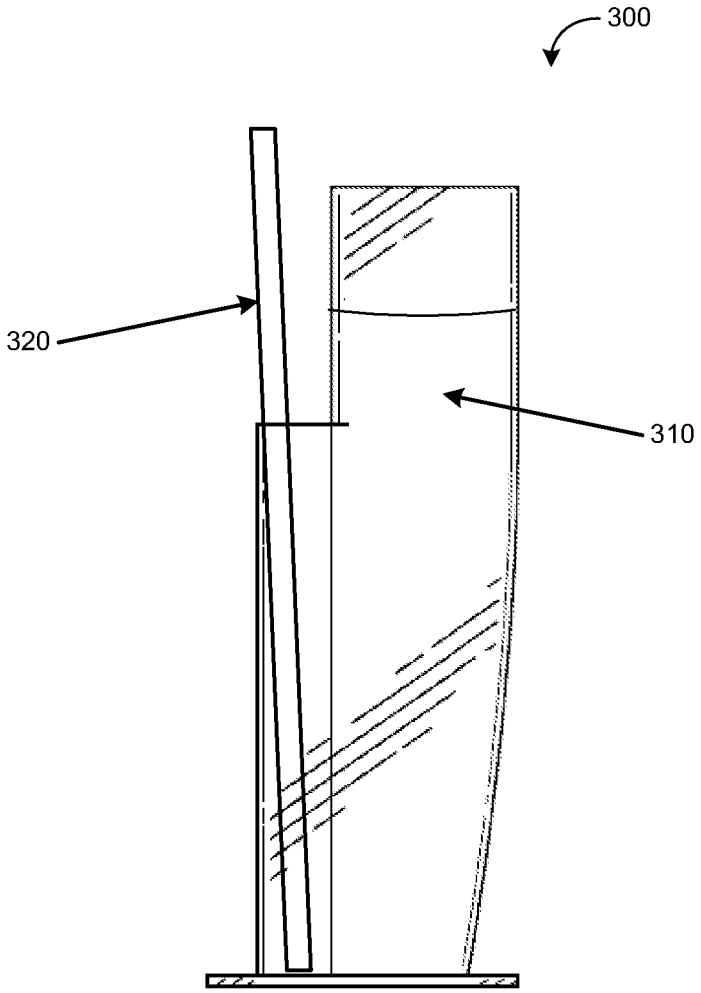
FIG. 3 illustrates a multi-compartment apparatus holding liquid and other materials, under an embodiment.

FIG. 3 illustrates a multi-compartment apparatus holding liquid and other materials, under an embodiment. As discussed above, the apparatus 300 can be used to hold various materials and/or products. In the example provided in FIG. 3, the apparatus 300 holds water 310 in the first compartment, and simultaneously holds a package of sheets of edible rice paper 320 (or individual sheets of rice paper) in the second compartment. The apparatus 300 has certain dimensions so that the rice paper 320 protrudes from the opening of the second compartment (and is taller than the height of the first compartment). This enables a user to easily grab a sheet (or multiple sheets) of rice paper from the compartment in order to dip the sheet of rice paper into the water 310. According to an embodiment, the opening and width of the first compartment holding the water 310 is wider than the opening and width of the second compartment so that the user can easily dip the rice paper into the water 310. The apparatus 300 can be formed of translucent or semi-translucent material so that a user can see the water level of the water 310 in the first compartment and refill the first compartment if the water level is low (e.g., below a line marked on the apparatus).

Although FIGS. 1A-3 illustrate the first compartment being larger in volume than the second compartment, and illustrate the apparatus having a particular design, as discussed above, the shapes and sizes of the compartments can be different than illustrated. In alternative embodiments, the sizes and shapes of dimensions of the compartments can be switched (e.g., the second compartment can be larger in size than the first compartment) and/or the compartments can be symmetric to each other or asymmetric from each other in one or more dimensions. In some embodiments, three or more compartments can be provided in the apparatus (e.g., a third compartment can be positioned on the base and share a different wall with the first compartment). According to another embodiment, the widths and/or lengths of the first and/or the second compartments may have a constant size or length.

It is contemplated for embodiments described herein to extend to individual elements and concepts described herein, independently of other concepts, ideas or system, as well as for embodiments to include combinations of elements recited anywhere in this application. Although embodiments are described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. This, the absence of describing combinations should not preclude the inventor from claiming rights to such combinations.

What is claimed is:

1. A food preparation apparatus comprising:

a base;

a first compartment having a first opening, the first compartment (i) being adjoined to and positioned on the base, and (ii) having a wall that is substantially perpendicular to the base; and a second compartment having a second opening that is smaller than the first opening, the second compartment (i) being adjoined to and positioned on the base, and (ii) sharing at least a portion of the wall;

wherein the base provides an enclosure for the first compartment and an enclosure for the second compartment;

wherein the first compartment has a first width and a first length, the first length (i) being constant for a portion of a height of the first compartment, and (ii) decreasing in size in another portion of the height of the first compartment, and wherein the second compartment has a second width and a second length, the second length being equal to the first length, the second width being smaller than the first width.

2. The apparatus of claim 1, wherein the first compartment has a first height from the base to the first opening, and wherein the second compartment has a second height from the base to the second opening.

3. The apparatus of claim 2, wherein the first opening and the second opening are each positioned parallel to the base.

4. The apparatus of claim 1, wherein the first opening includes four rounded corners, and wherein the second opening (i) is formed at least in part by the wall and (ii) includes two rounded corners.

5. The apparatus of claim 1, wherein the first width (i) is constant for a portion of the height of the first compartment, and (ii) decreases in size in another portion of the height of the first compartment.

6. The apparatus of claim 1, wherein the first width is at least two times larger than the second width.

7. The apparatus of claim 1, wherein the first opening is substantially rectangular in shape.

8. The apparatus of claim 1, wherein the apparatus is formed from a translucent or semi-translucent material.

9. The apparatus of claim 1, wherein the apparatus is formed from plastic, metal, ceramic, or glass.

10. The apparatus of claim 1, wherein at least the first compartment or the second compartment is sealed with the base to be able to hold liquid.

11. A food preparation container for retaining liquid comprising:

a base;

a first compartment having a first height from the base to a first opening, the first compartment (i) being adjoined to and positioned on the base, and (ii) having a wall that is substantially perpendicular to the base; and a second compartment having a second height from the base to a second opening, wherein the second height is shorter than the first height, the second compartment (i) being adjoined to and positioned on the base, and (ii) sharing at least a portion of the wall;

wherein the base provides an enclosure for the first compartment and an enclosure for the second compartment;

wherein the first compartment has a first width and a first length, the first width (i) being constant for a portion of the first height, and (ii) decreasing in size in another portion of the first height, and wherein the second compartment has a second width and a second length, the second length being equal to the first length, the second width being constant for an entirety of the second height and being smaller than the first width.

12. The container of claim 11, wherein the first opening and the second opening are each positioned parallel to the base.

13. The container of claim 11, wherein the first opening includes four rounded corners, and wherein the second opening (i) is formed at least in part by the wall and (ii) includes two rounded corners.

14. The container of claim 13, wherein the base is rectangular, elliptical, or circular in shape.

15. The container of claim 11, wherein the first length (i) is constant for a portion of the first height, and (ii) decreases in size in another portion of the first height.

16. The container of claim 11, wherein the first opening is substantially rectangular in shape.

17. The container of claim 11, wherein the container is formed from a translucent or semi-translucent material.

18. The container of claim 11, wherein the container is formed from plastic, metal, ceramic, or glass.

* * * * *